US007019508B2

(12) United States Patent
Rategh et al.

(10) Patent No.: US 7,019,508 B2
(45) Date of Patent: Mar. 28, 2006

(54) TEMPERATURE COMPENSATED BIAS NETWORK

(75) Inventors: Hamid Reza Rategh, Cupertino, CA (US); Behzad Tavassoli Hozouri, Santa Clara, CA (US)

(73) Assignee: Anadigics Inc., Warren, NJ (US)

( * ) Notice: Subject to any disclaimer, the term of this patent is extended or adjusted under 35 U.S.C. 154(b) by 57 days.

(21) Appl. No.: 10/875,819

(22) Filed: Jun. 24, 2004

(65) Prior Publication Data

US 2005/0285586 A1 Dec. 29, 2005

(51) Int. Cl.
*G05F 3/16* (2006.01)

(52) U.S. Cl. ..... 323/314; 323/315; 327/543

(58) Field of Classification Search ..... 323/312, 323/313, 314, 315, 316; 327/540, 541, 543, 327/545, 546
See application file for complete search history.

(56) References Cited

U.S. PATENT DOCUMENTS 5,834,967 A * 11/1998 Kuroda et al. ..... 327/543
6,094,041 A * 7/2000 Wachter ..... 323/315
6,831,505 B1 * 12/2004 Ozoe ..... 327/541

* cited by examiner

*Primary Examiner*—Jessica Han
(74) *Attorney, Agent, or Firm*—H. Black, P.E.

(57) ABSTRACT

A method and apparatus for a temperature compensated bias network, such as may be embodied as an integrated circuit is disclosed. Embodiments provide for a wide range of desired temperature characteristics with good stability. Current mirror components with active leakage circuits may act to provide consistent operating parameters over a wide range of temperatures. Improved compensation and linearity may be provided using features disclosed.

12 Claims, 12 Drawing Sheets

200

| Ref. | Parameter | Parameter Value | Units |
|---|---|---|---|
| Vref. | voltage | 2.85 | Volt |
| Vcc | voltage | 3.4 | Volt |
| R1 | Resistance | 83 | Ohm |
| R2 | Resistance | 1 | Ohm |
| BJT1 | Emitter area | 6.5 | M number / unit cell |
| BJT2 | Emitter area | 0.5 | M number / unit cell |
| BJT5 | Emitter area | 0.5 | M number / unit cell |
| BJT3 | Emitter area | 3 | M number / unit cell |
| R3 | Resistance | 786 | Ohm |
| BJT4 | Emitter area | 7 | M number / unit cell |
| R4 | Resistance | 61 | Ohm |
| R6 | Resistance | 3 | Ohm |
| BJT6 | Emitter area | 10 | M number / unit cell |
| R5 | Resistance | 301 | Ohm |
| Io | Output current | See figure 3 | milliAmp |
| T | Ambient Temperature | See figure 3 | Celsius |
| Vbias | voltage | 2.85 | Volt |

Figure 2

| Ref. | Parameter | Parameter Value | Units |
|---|---|---|---|
| Vref. | voltage | 2.85 | Volt |
| Vcc | voltage | 3.4 | Volt |
| R1 | Resistance | 285 | Ohm |
| R2 | Resistance | 13 | Ohm |
| BJT1 | Emitter area | 2.5 | M number / unit cell |
| BJT2 | Emitter area | 1.5 | M number / unit cell |
| BJT5 | Emitter area | 1.5 | M number / unit cell |
| BJT3 | Emitter area | 2.75 | M number / unit cell |
| R3 | Resistance | 1497 | Ohm |
| BJT4 | Emitter area | 2 | M number |
| R4 | Resistance | 11563 | Ohm |
| R6 | Resistance | 3 | Ohm |
| BJT6 | Emitter area | 14 | M number / unit cell |
| R5 | Resistance | 4583 | Ohm |
| Io | Output current | See figure 5 | milliAmp |
| T | Ambient Temperature | See figure 5 | Celsius |
| Vbias | voltage | 2.85 | Volt |

Figure 4

| Ref. | Parameter | Parameter Value | Units |
|---|---|---|---|
| Vref. | voltage | 2.85 | Volt |
| Vcc | voltage | 3.4 | Volt |
| R1 | Resistance | 61 | Ohm |
| R2 | Resistance | 17 | Ohm |
| BJT1 | Emitter area | 0.5 | M number / unit cell |
| BJT2 | Emitter area | 0.5 | M number / unit cell |
| BJT5 | Emitter area | 0.5 | M number / unit cell |
| BJT3 | Emitter area | 0.5 | M number / unit cell |
| R3 | Resistance | 12672 | Ohm |
| BJT4 | Emitter area | 7.5 | M number |
| R4 | Resistance | 1254 | Ohm |
| R6 | Resistance | 3 | Ohm |
| BJT6 | Emitter area | 10 | M number / unit cell |
| R5 | Resistance | 10000 | Ohm |
| Io | Output current | See figure 7 | milliAmp |
| T | Ambient Temperature | See figure 7 | Celsius |
| Vbias | voltage | 2.85 | Volt |

Figure 6

| Ref. | Parameter | Parameter Value | Units |
|---|---|---|---|
| Vref. | voltage | 2.85 | Volt |
| Vcc | voltage | 3.4 | Volt |
| R1 | Resistance | 196 | Ohm |
| R2 | Resistance | 17 | Ohm |
| BJT1 | Emitter area | 5.5 | M number / unit cell |
| BJT2 | Emitter area | 0.5 | M number / unit cell |
| BJT5 | Emitter area | 0.5 | M number / unit cell |
| BJT3 | Emitter area | 1 | M number / unit cell |
| R3 | Resistance | 83.5 | Ohm |
| BJT4 | Emitter area | 2 | M number / unit cell |
| R4 | Resistance | 76000 | Ohm |
| R6 | Resistance | 3 | Ohm |
| BJT6 | Emitter area | 10 | M number / unit cell |
| R5 | Resistance | 1 | Ohm |
| Io | Output current | See figure 10 | milliAmp |
| T | Ambient Temperature | See figure 10 | Celsius |

Figure 9

| Ref. | Parameter | Parameter Value | Units |
|---|---|---|---|
| Vref. | voltage | 2.85 | Volt |
| Vcc | voltage | 3.4 | Volt |
| R1 | Resistance | 7 | Ohm |
| R2 | Resistance | 94 | Ohm |
| BJT1 | Emitter area | 6 | M number / unit cell |
| BJT2 | Emitter area | 0.5 | M number / unit cell |
| BJT5 | Emitter area | 0.5 | M number / unit cell |
| BJT3 | Emitter area | 0.5 | M number / unit cell |
| R3 | Resistance | 5200 | Ohm |
| BJT4 | Emitter area | 4.25 | M number / unit cell |
| R4 | Resistance | 67000 | Ohm |
| R6 | Resistance | 3 | Ohm |
| BJT6 | Emitter area | 10 | M number / unit cell |
| R5 | Resistance | 19600 | Ohm |
| Io | Output current | See figure 12 | milliAmp |
| T | Ambient Temperature | See figure 12 | Celsius |

Figure 11

TEMPERATURE COMPENSATED BIAS NETWORK

FIELD OF THE INVENTION

The invention generally relates to electronics circuits. The invention more particularly relates to amplifier circuits, for example, RF (radio frequency) PA (power amplifier) circuits especially integrated circuits for microwave signals.

BACKGROUND OF THE INVENTION

Modern designs for high power and high performance ICs (integrated circuits) RF (radio frequency) signals meet their considerable challenges by deploying any of a variety of technologies, often including out of the mainstream techniques. Dense and highly integrated designs for processing analog signals often have a very limited electrical operating range and, especially when low voltage power supplies must be conformed to, such circuits may require bias currents (and/or voltages) to be controlled with great precision and robustness.

Superior control of bias voltages across a wide range of operating conditions such as temperature may be achieved by exploiting refinements disclosed infra.

The disclosed improved circuit designs are capable of superior tradeoffs between circuit performance, manufacturing yield and cost.

SUMMARY

Accordingly, the invention provides bias circuits with superior performance including stability in the face of temperature variation. Such bias circuits may be implemented as an IC (integrated circuit) with bipolar transistors as disclosed herein. However the invention is not limited to bipolar devices, nor even necessarily to dense integrated, although that is usual and usually desirable. CMOS or other semiconductor technologies such as SiGe (silicon-germanium), GaAs (Gallium Arsenide) or InP (Indium Phosphate) or other III-IV semiconductor bipolar, HBT (heterojunction bipolar transistor) or FET (field-effect transistor) devices may also be used. High operating frequency (e.g., microwave) may be supported through LSI (large scale integration), as is well-known in the art. Superior performance results from aspects of the novel designs.

According to a first aspect of the invention, a circuit for providing a temperature compensated current comprising a first input transistor and a first output transistor, an input buffer transistor, an output buffer transistor and a temperature dependent circuit block is disclosed. The circuit may provide an output current having a specific desired performance over temperature.

Within the disclosed circuits control currents may be generated as a function of a ratio of leakage currents for at least two buffer transistors with at least one of the leakage currents being intentionally temperature dependent.

According to another aspect of the invention, methods are disclosed which are used in the embodied circuits of the first aspects.

Several variants of these aspects are also disclosed together with alternative exemplary embodiments.

BRIEF DESCRIPTION OF THE DRAWINGS

The accompanying drawings, which are incorporated in and constitute a part of the specification, illustrate an embodiment of the invention, and, together with the description, serve to explain the principles of the invention:

FIG. 2 shows a table of component values and parameters that may be applied to the circuit of FIG. 1 to produce a practical circuit embodiment that has been simulated to illustrate the invention.

FIG. 4 shows another table of component values and parameters that may be applied to the circuit of FIG. 1 to produce a further practical circuit embodiment.

FIG. 6 shows another table of component values and parameters that may be applied to the circuit of FIG. 1 to produce a still further practical circuit embodiment.

FIG. 9 shows a table of component values and parameters that may be applied to the circuit of FIG. 8 to produce a still further practical circuit embodiment.

FIG. 11 shows another table of component values and parameters that may be applied to the circuit of FIG. 8 to produce still further practical circuit embodiment.

For convenience in description, identical components have been given the same reference numbers in the various drawings.

DETAILED DESCRIPTION OF THE PREFERRED EMBODIMENTS

Figure 1:
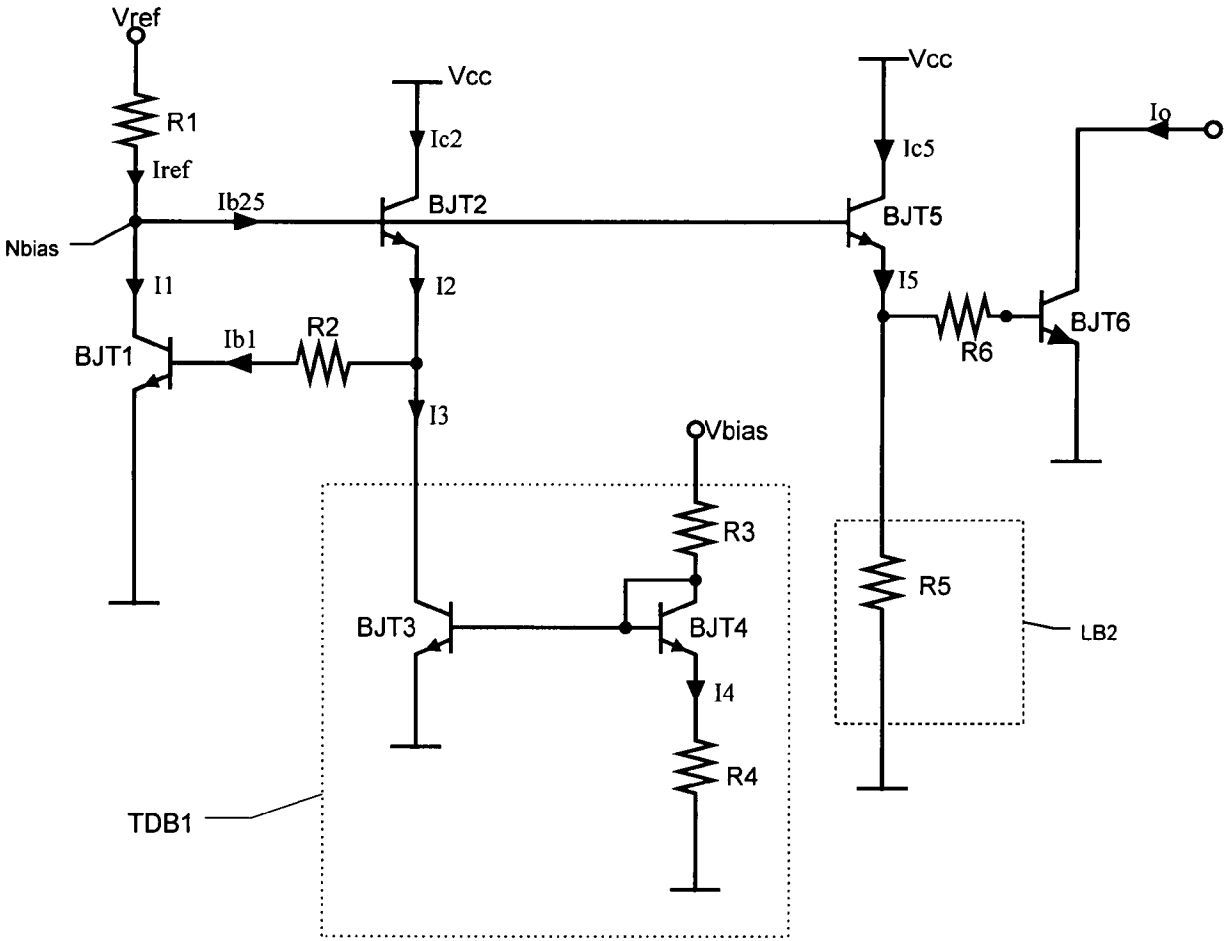
FIG. 1 is a schematic diagram of a part of an integrated circuit according to an embodiment of a bias circuit according to an exemplary embodiment of the invention.

In the following description, for purposes of clarity and conciseness of the description, not all of the numerous components shown in the schematics and/or drawings are described. The numerous components are shown in the drawings to provide a person of ordinary skill in the art a thorough, enabling disclosure of the present invention. The operation of many of the components would be understood and apparent to one skilled in the art.

FIG. 1 is a schematic diagram of a part of an integrated circuit 200 (IC) according to an embodiment of a bias circuit according to an exemplary embodiment of the invention. As shown, IC 200 implements an exemplary analog bias circuit, and in the present example bipolar technologies are used.

Referring to FIG. 1, the bias network circuit 200 provides a 0 Hz output current Io. In a typical embodiment BJT6 may be a device intended to be biased into an active region so as to act as a transistor that receives an RF input signal, or to create a reference voltage by passing the current through a resistor.

Also, in another typical embodiment of the invention, Io may provide the bias current for a control terminal of an active device, for example, an external transistor biased into a linear active region and placed so as to receive an input RF. Circuit parameters may be chosen to give the magnitude of Io whatever characteristic over temperature may be desired. In many cases an output bias current that is precisely set and constant over a wide range of operating temperatures may be desired. In some cases it may be desirable to have an output current that has a negative temperature coefficient, that is a current which decreases with increasing temperature. It may even be desirable to have current with a positive temperature coefficient, though relatively simpler circuits could also serve that purpose. It can be a manufacturing convenience to use a relatively standardized circuit in preference to a simpler, and ostensibly cheaper, circuit.

Still referring to FIG. 1, the input reference voltage Vref and the reference resistance R1 together act to set an input reference current Iref.

A theoretical analysis of the circuit of FIG. 1 now follows. This analysis is not limiting of the invention but may be useful for reaching a good understanding of one particular embodiment of the invention, moreover it is not the only valid way of looking theories of operation of the invention and is purely exemplary.

Still referring to FIG. 1, the following symbols are used:

The bias voltage at the bias node Nbias is Vrefbias.

The base-emitter voltage at output transistor BJT6 is Vbe6.

The voltage developed across resistance R6 is Vr6.

The base-emitter voltage at buffer transistor BJT5 is Vbe5.

The base-emitter voltage at current mirror input transistor BJT1 is Vbe1.

The voltage developed across resistance R2 is Vr2.

The base-emitter voltage at buffer transistor BJT2 is Vbe2.

By voltage summation, $$Vrefbias=Vbe6+Vr6+Vbe5=Vbe1+Vr2+Vbe2$$

It follows that if R6 and R2 are sized so that Vr6≈Vr2, or, alternatively, if R6 and R2 are small enough so that |Vr2−Vr6|<<Vbe1+Vbe2 then . . .

$$Vbe6+Vbe5\approx Vbe1+Vbe2 \quad \text{(Equation 1)}$$

A well known relationship for Bipolar transistors provides that collector current Ic may be expressed as:

$$Ic=Iso*A*(\exp(Vbe/V_T-1)(1+Vce/V_A)$$

wherein A is the effective emitter area, Vbe the base-emitter voltage, $V_T$ the thermal voltage for the operating temperature, Vce the collector-emitter voltage and $V_A$ the Early voltage.

Taking the usual and valid approximations that Vce<<$V_A$ and Vbe>>$V_T$, then rearranging the terms leads to:

$$Vbe\approx V_T+1n(Ic/(Iso*A)) \quad \text{(Equation 2).}$$

Substituting Equation 2 into Equation 1 for each bipolar transistor leads to:

$$Ic6=((A6*A5)/(A1*A2))*(Ic2*Ic1/Ic5)$$

wherein Ic6, Ic2, Ic1 and Ic5 represent the collector currents of the respective transistors and A6, A2, A1 and A5 are the effective emitter areas of the respective transistors.

Recalling from the circuit topology that Ic6 is equal to Io, the output current, inspection of the equations reveals that Io is proportional to Ic1. Also I1=I2−Ib1 and due to the current gain (Beta) of BJT1 Ib1 is small and so I2 and I3 are nearly equal. Further inspection of the equations reveals that Io is also proportional to I2 and hence to I3 (or Ic3). Also Io is inversely proportional to Ic5. And since the circuit design permits setting of Ic3 and/or Ic5 with great flexibility at the design stage, and since the use of at least one temperature dependent block is envisaged, then considerable design flexibility is provided for creating almost any desired temperature characteristic for Io. In the exemplary circuit of FIG. 1, Ic3 is controlled by temperature dependent block TDB1 and Ic5 is controlled by a simple resistive load block LB2.

In the circuit of FIG. 1, resistors R2 and R6 may act as ballast resistors to prevent thermal runaway by limiting the transistor base current into transistors BJT1 and BJT6 respectively. However resistors R2 and R6 are not critical to the invention and may be omitted or substituted with other components in some embodiments.

Still referring to FIG. 1, transistors BJT2 and BJT5 act as buffers so that most of the base current of transistors BJT1 and BJT6 respectively are supplied from Vcc, and hence Ib25 is minimized and I1 is very nearly equal to Iref. BJT2 and BJT5 are exemplary only, other buffering arrangements may be used to retain the present functionality while keeping I1 and Iref very nearly equal to each other. In the exemplary embodiment of the invention leakage load block LB2 is embodied as resistor R5 act to provide an appropriate level of leakage and quiescent current so as to place transistor BJT5 at a good or optimal operating point. In variations of the present embodiment of the invention, LB2 may be embodied as a diode junction, a resistive element or both (typically in series) or other components within the general scope of the invention. Temperature compensating block TDB1 provides leakage and quiescent current for transistor BJT2 similarly.

However, temperature-compensating block TDB1 has a number of degrees of freedom in its design. In particular, the ratios of the emitter areas of transistors BJT3 and BJT4 can be chosen with a great deal of freedom and the values of R3 and R4 (or similar functioning component embodiment such as a diode junction) may be chosen at will. Circuit parameters, especially the geometry of BJT3 and BJT4 and the values of R3 and R4 can each be determined by ordinary circuit simulation techniques to provide almost any desired performance over temperature of Io.

Figure 3:
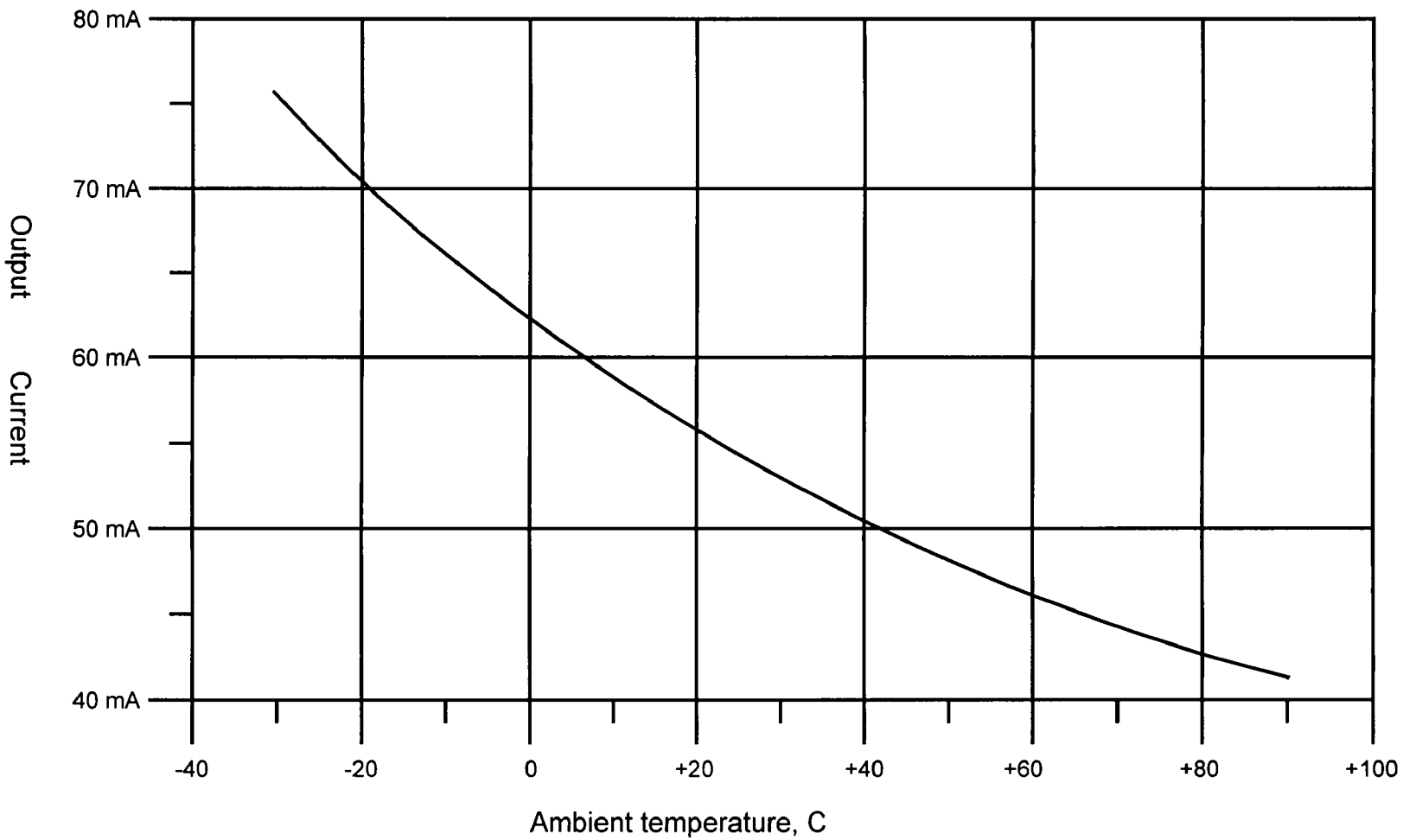
FIG. 3 shows the corresponding characteristic performance curve of the circuit of FIG. 1 with the component parameters of FIG. 2.

FIG. 2 shows a table of component values and parameters that may be applied to the circuit of FIG. 1 to produce a practical circuit embodiment that has been simulated to illustrate the invention. FIG. 3 shows the corresponding characteristic performance curve of the circuit of FIG. 1 with the component parameters of FIG. 2. It can be clearly seen that the output current Io in this particular embodiment exhibits negative temperature coefficients and is quasi-linear, and the shape of the curve can be adjusted by modifying circuit component values.

Figure 5:
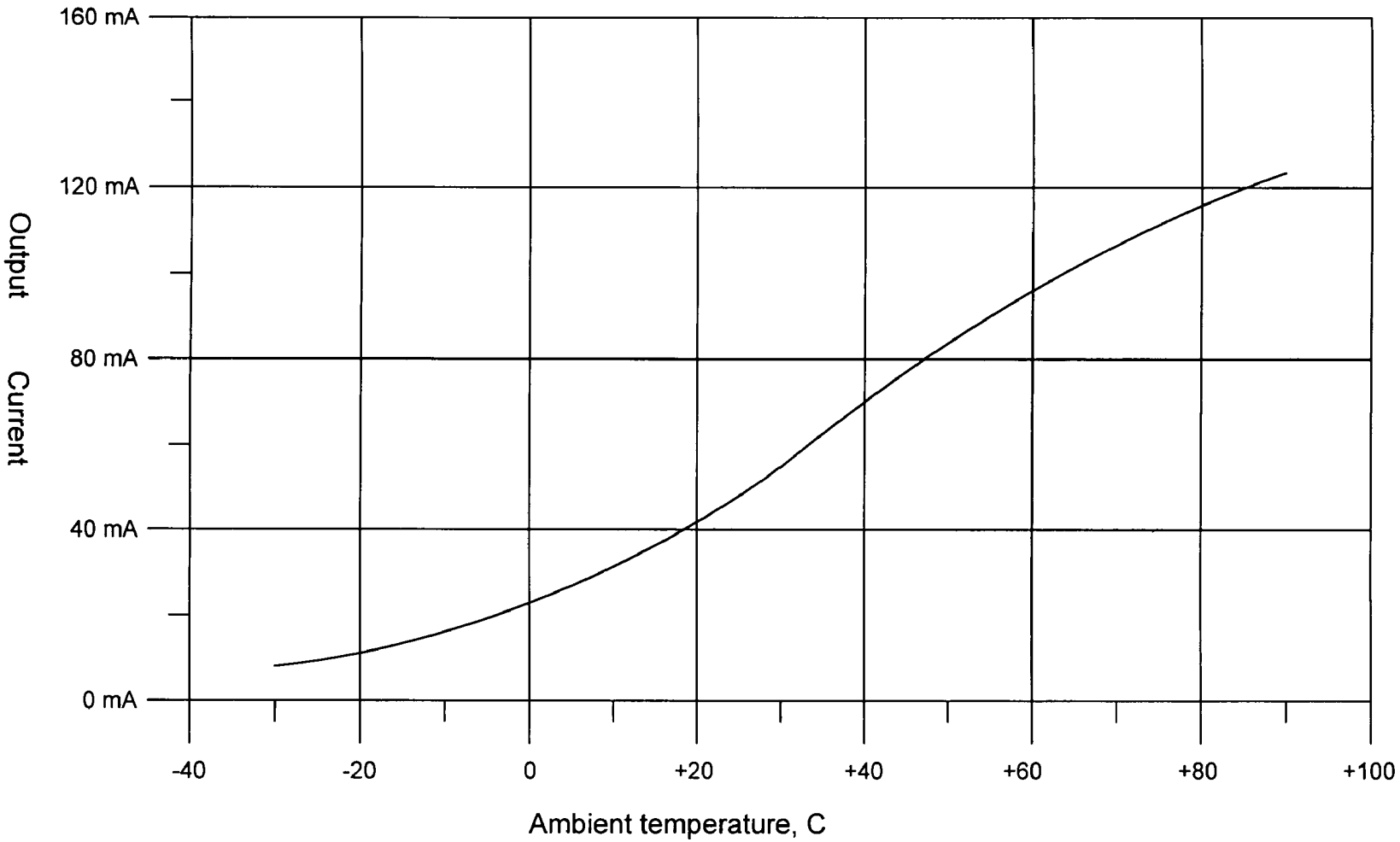
FIG. 5 shows the corresponding characteristic performance curve of the circuit of FIG. 1 with the component parameters of FIG. 4.

Similarly, FIG. 4 shows another table of component values and parameters that may be applied to the circuit of FIG. 1 to produce a further practical circuit embodiment that has also been simulated to illustrate the invention. FIG. 5 shows the corresponding characteristic performance curve of the circuit of FIG. 1 with the component parameters of FIG. 4. It can be clearly seen that, in contrast with the embodiment of FIGS. 1, 2, 3, the output current Io in this alternative embodiment exhibits positive temperature coefficients, and the shape of the curve can be adjusted by modifying circuit component values.

Figure 7:
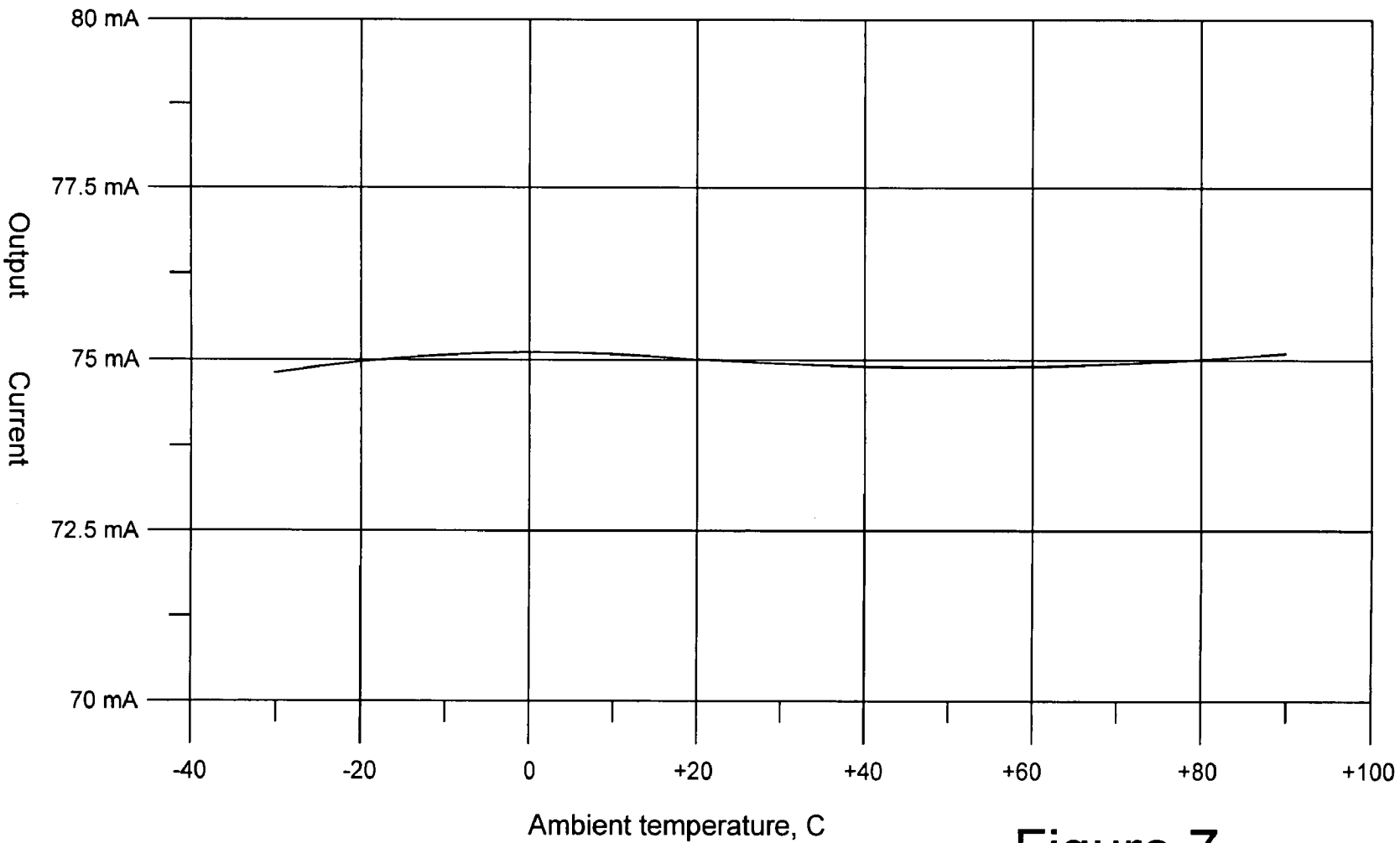
FIG. 7 shows the corresponding characteristic performance curve of the circuit of FIG. 1 with the component parameters of FIG. 6.

Similarly, FIG. 6 shows another table of component values and parameters that may be applied to the circuit of FIG. 1 to produce a further practical circuit embodiment that has also been simulated to illustrate the invention. FIG. 7 shows the corresponding characteristic performance curve of the circuit of FIG. 1 with the component parameters of FIG. 6. It can be clearly seen that, in contrast with the embodiment of FIGS. 1, 2, 3, the output current Io in this alternative embodiment exhibits substantially flat temperature peformance.

Figure 8:
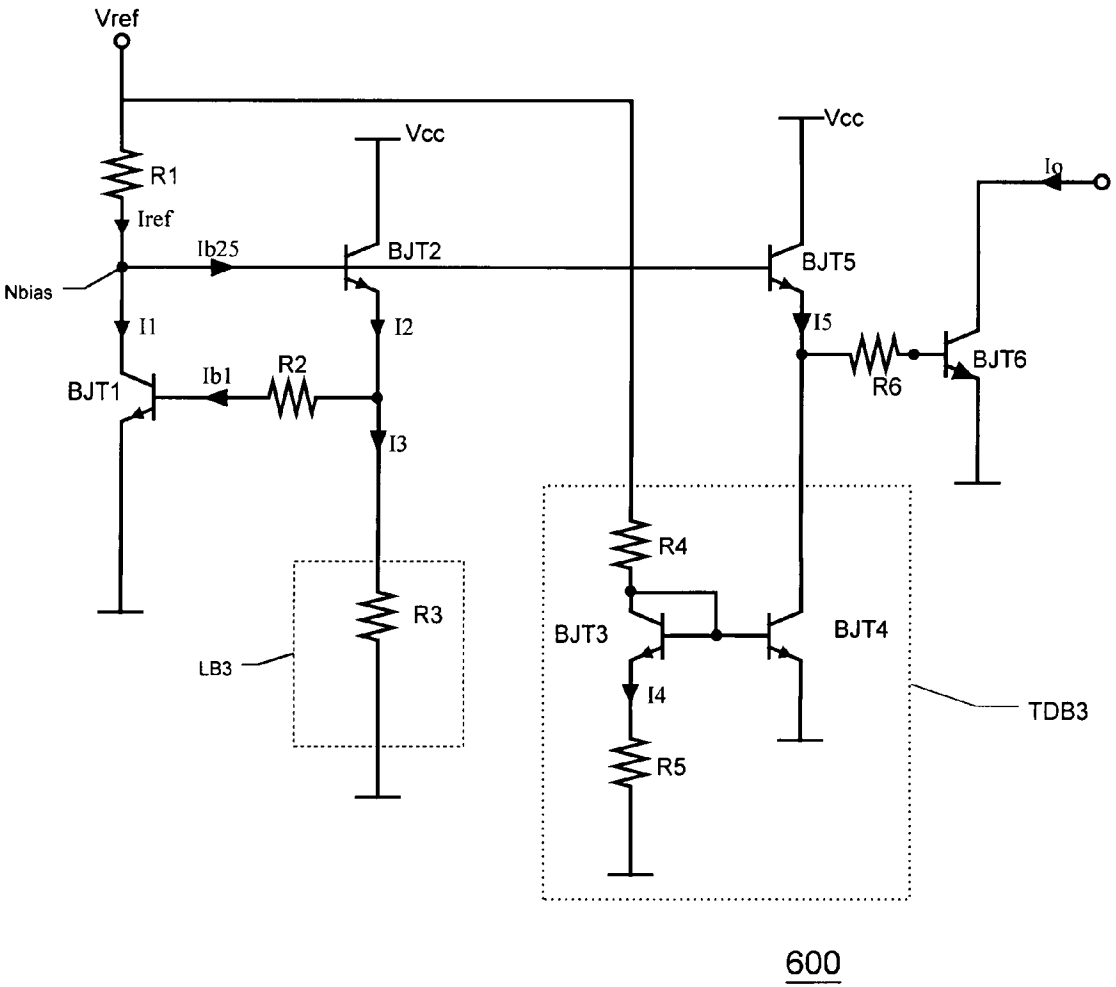
FIG. 8 is a schematic diagram of a part of an alternative integrated circuit according to another embodiment of a bias circuit according to another exemplary embodiment of the invention.

FIG. 8 is a schematic diagram of a part of an alternative integrated circuit 600 (IC) according to another embodiment of a bias circuit according to another exemplary embodiment of the invention. FIG. 8 is reminiscent of FIG. 1. However, contrasting FIG. 8 with FIG. 1 it becomes apparent that the topological positions of equivalent leakage load blocks (LB2, LB3) and equivalent temperature-compensating blocks (TDB1, TDB3) respectively have been, loosely speaking, interchanged. This effectively shifts the temperature control from the input side of the circuit to the output side. Doing so may affect energy management and quantizing effects within the design but the functionality of each of the approaches is essentially equivalent. Also in FIG. 8, the Vbias (of FIG. 1) has been derived from Vref purely as a convenience and no loss of generality is implied thereby.

Figure 10:
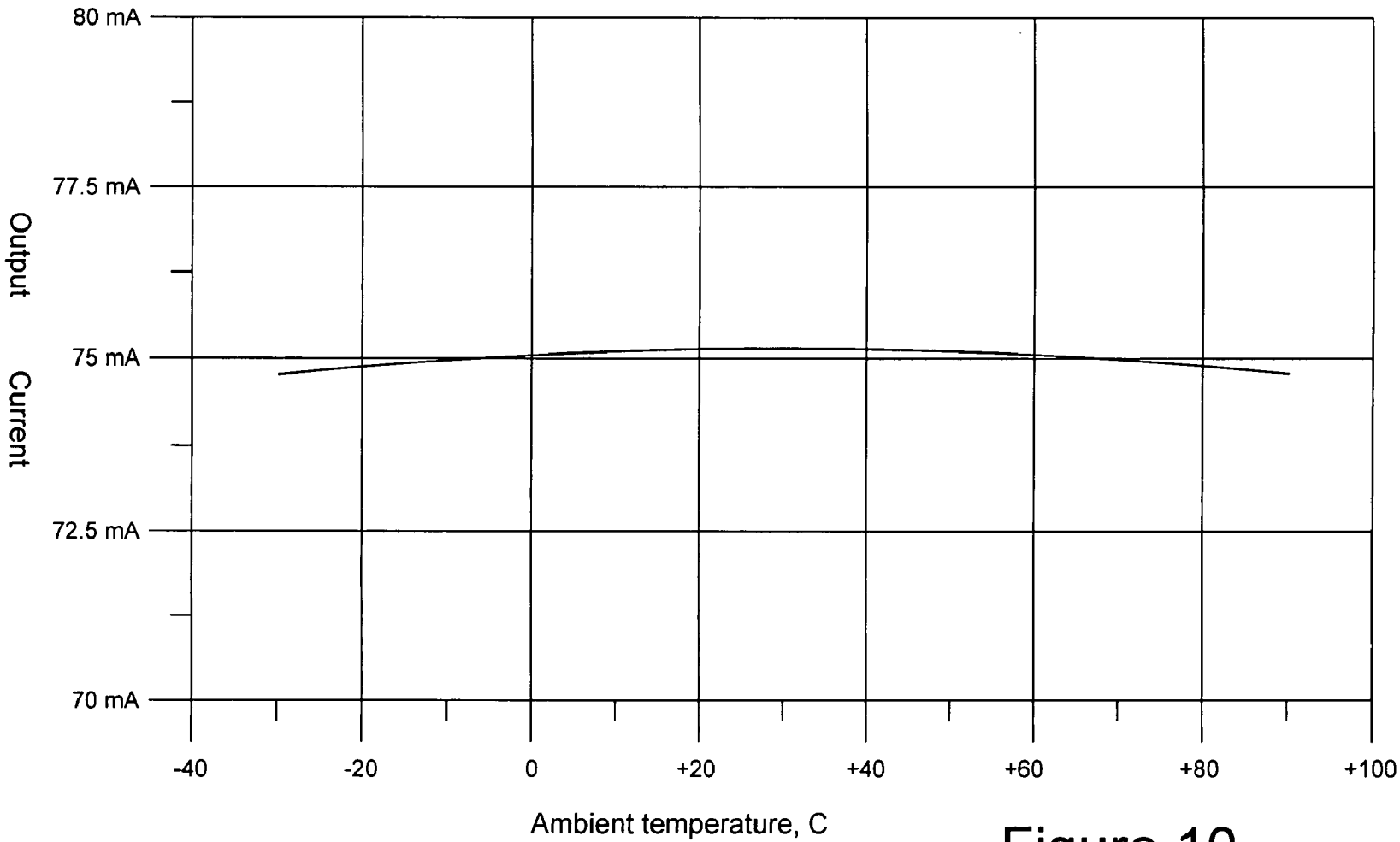
FIG. 10 shows the corresponding characteristic performance curve of the circuit of FIG. 8 with the component parameters of FIG. 9.
Figure 12:
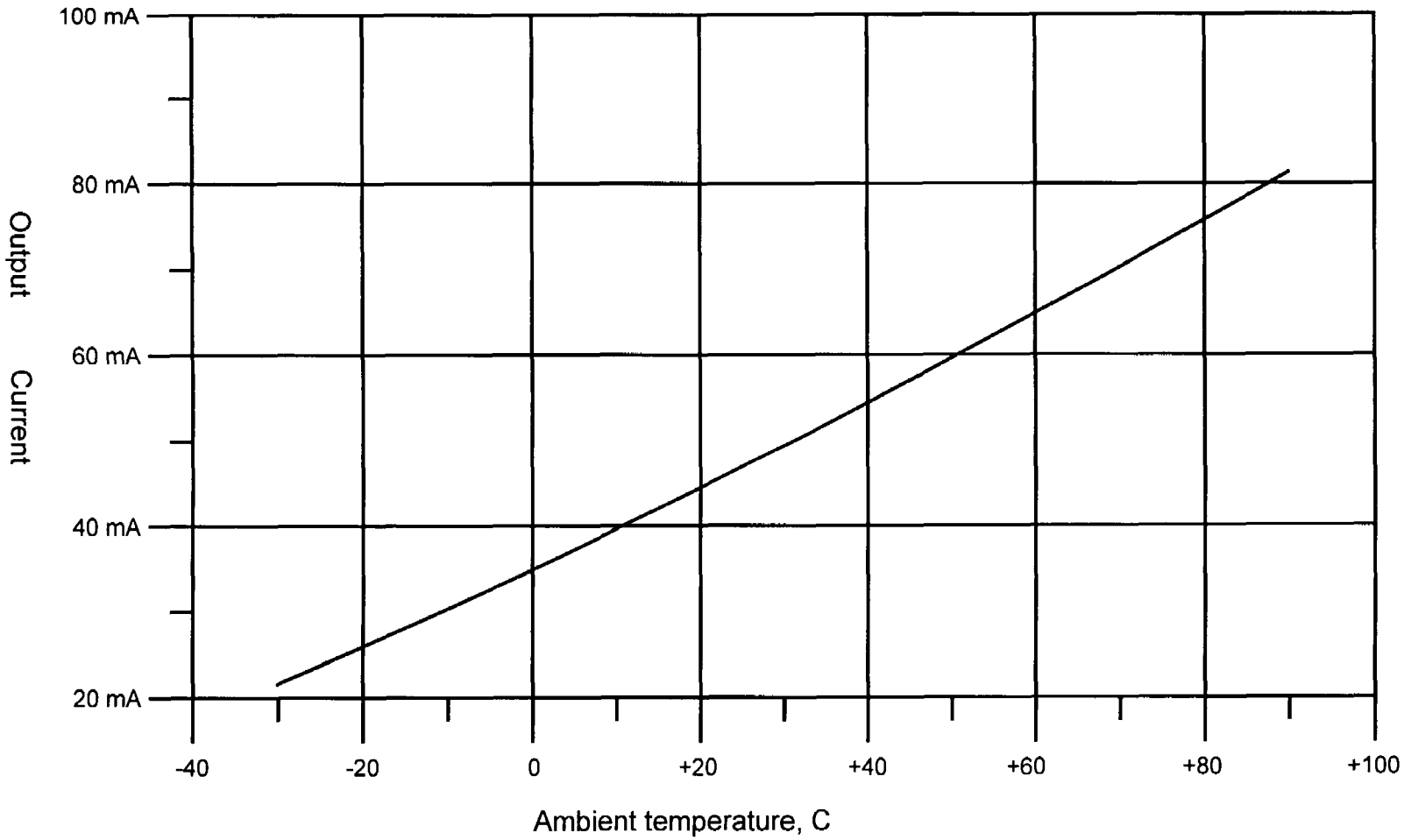
FIG. 12 shows the corresponding characteristic performance curve of the circuit of FIG. 8 with the component parameters of FIG. 11.

FIG. 9 shows a table of component values and parameters that may be applied to the circuit of FIG. 8 to produce a still further practical circuit embodiment that has been simulated to illustrate the invention. FIG. 10 shows the corresponding characteristic performance curve of the circuit of FIG. 8 with the component parameters of FIG. 9. It can be clearly seen that the output current Io in this particular embodiment exhibits a substantially flat temperature response.

FIG. 11 shows another table of component values and parameters that may be applied to the circuit of FIG. 8 to produce a still further practical circuit embodiment that has been simulated to illustrate the invention. FIG. 11 shows the corresponding characteristic performance curve of the circuit of FIG. 8 with the component parameters of FIG. 11. It can be clearly seen that the output current Io in this particular embodiment exhibits a substantially linear positive temperature coefficient, and the shape of the curve can be adjusted by modifying circuit component values.

Further embodiments of the invention may be extended to include other circuit configurations, especially those not limited to the use of resistors or single transistors where multiples may be substituted. And as will be apparent to one of ordinary skill in the art, still further similar circuit arrangements are possible within the general scope of the invention.

For example, it may be envisaged that temperature compensation blocks may be used on both sides of the bias circuitry rather than one side, for example replacing LB blocks in the disclosed circuits with TDB blocks. As a further example additional current mirrors may be introduced to make control more indirect but within the general scope of the invention. Moreover, CMOS implementations may be provided as is well known in the art. Further examples may include circuits embodied using discrete transistors or as integrated circuits, using metal-oxide semiconductors or other field effect transistors, and/or with Gallium Arsenide or SiGe HBT transistors or other technologies.

As a further example of a variation within the general scope of the invention, a circuit topology may be used wherein one or more temperature-compensating circuits source current rather than sink it, for example using PNP bipolar transistors.

Other active devices could also be used to construct an embodiment of the invention using the appropriate circuit arrangements.

Also it is possible to replace analog circuit components with digital functional equivalents within the general scope of the invention. The embodiments described above are exemplary rather than limiting and the bounds of the invention should be determined from the claims.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A circuit for providing a temperature compensated current comprising:

a input transistor having an input transistor control terminal and having an input transistor current terminal passing a reference current;

a first buffer transistor having a first buffer transistor control terminal operable to receive a buffer control voltage proportional to the reference current and further having a first buffer transistor current terminal operable to pass a first leakage current;

a first leakage block comprising a temperature dependent block operable to pass the first leakage current;

a second buffer transistor having a second buffer transistor control terminal operable to receive the buffer control voltage and further having a second buffer transistor current terminal operable to pass a second leakage current;

a second leakage block operable to pass the second leakage current; and an output transistor operable to generate an output current proportional to the reference current and further proportional to a ratio of the first and second leakage currents.

2. The circuit of claim 1 wherein:

the second leakage block consists of an ohmic resistance.

3. The circuit of claim 1 wherein:

the second leakage block comprises a diode.

4. The circuit of claim 3 wherein:

the second leakage block further comprises an ohmic resistance.

5. The circuit of claim 1 wherein the temperature dependent block comprises a current mirror and an offset linearizing resistor.

6. A circuit for providing a temperature compensated current comprising:

a input transistor having an input transistor control terminal and having an input transistor current terminal passing a reference current;

a first buffer transistor having a first buffer transistor control terminal operable to receive a buffer control voltage proportional to the reference current and further having a first buffer transistor current terminal operable to pass a first leakage current;

a first leakage block operable to pass the first leakage current;

a second buffer transistor having a second buffer transistor control terminal operable to receive the buffer control voltage and further having a second buffer transistor current terminal operable to pass a second leakage current;

a second leakage block comprising a temperature dependent block operable to pass the second leakage current; and an output transistor operable to generate an output current proportional to the reference current and further proportional to a ratio of the first and second leakage currents.

7. The circuit of claim 6 wherein:

the first leakage block consists of an ohmic resistance.

8. The circuit of claim 6 wherein:

the first leakage block comprises a diode.

9. The circuit of claim 8 wherein:

the first leakage block further comprises an ohmic resistance.

10. The circuit of claim 6 wherein the temperature dependent block comprises a current mirror and an offset linearizing resistor.

11. A method for providing a temperature compensated current comprising the acts of:

mirroring a proportion of a reference current using an input transistor having an input transistor control terminal passing a control current and further using an output transistor;

providing an input buffer transistor and an output buffer transistor;

ratioing a temperature dependent leakage current of the input buffer transistor with a leakage current of the output buffer transistor; and generating an output current proportional to the reference current and further proportional to the ratioing whereby the circuit operates to produce a current with temperature compensation.

12. A method for providing a temperature compensated current comprising the acts of:

mirroring a proportion of a reference current using an input transistor having an input transistor control terminal passing a control current and further using an output transistor;

providing an input buffer transistor and an output buffer transistor;

ratioing a leakage current of the input buffer transistor with a temperature dependent leakage current of the output buffer transistor; and generating an output current proportional to the reference current and further proportional to the ratioing whereby the circuit operates to produce a current with temperature compensation.

* * * * *